United States Patent [19]

Yeaman

[11] Patent Number: 4,865,316

[45] Date of Patent: Sep. 12, 1989

[54] ISOKINETIC EXERCISE APPARATUS FOR ARMS AND CHEST

[75] Inventor: Charles T. Yeaman, Salt Lake City, Utah

[73] Assignee: Power Play Tools, Inc., Salt Lake City, Utah

[21] Appl. No.: 208,609

[22] Filed: Jun. 20, 1988

[51] Int. Cl.[4] ..... A63B 21/02

[52] U.S. Cl. ..... 272/135; 272/137

[58] Field of Search ..... 272/135–138, 272/140, 141, 125, 93

[56] References Cited

U.S. PATENT DOCUMENTS

| | | | |
|---|---|---|---|
| 192,338 | 6/1877 | Marshall | 272/135 |
| 4,428,577 | 1/1984 | Weingardt | 272/137 |
| 4,778,173 | 10/1988 | Joutras | 272/75 |

FOREIGN PATENT DOCUMENTS

| | | | |
|---|---|---|---|
| 2258648 | 6/1974 | Fed. Rep. of Germany | 272/135 |

*Primary Examiner*—Richard J. Apley
*Assistant Examiner*—J. Welsh
*Attorney, Agent, or Firm*—Lynn G. Foster

[57] ABSTRACT

An elongated lightweight exercise device employed by the user to build and strengthen the muscles in the arms and chest area, comprising a short straight section of helically wound cable and two handles, one disposed at each end thereof. The wire rope may be coated with synthetic resinous material. Each handle comprises a hand-width long section of pipe enveloped by a plastic or foam grip with which to grasp the device, and a flexible strap with ends rotatably attached to each end of the pipe section in looped relation to the associated handle. To operate, the user inserts his hands through the straps and firmly grasps the plastic handle grips. Two equal and opposite inward forces are exerted on the handles by the user which causes the cable to bow under flexure stress. The user then allows the cable to return to its resting position due to the memory of the cable and repeats the procedure as appropriate. Repeated flexure over an indefinite interval of time does not incite fatigue in the cable. The straps guard against accidental loss of control of the device during use.

9 Claims, 3 Drawing Sheets

ISOKINETIC EXERCISE APPARATUS FOR ARMS AND CHEST

FIELD OF INVENTION

The present invention relates generally to exercise equipment and more particularly to a novel apparatus which effectively builds and strengthens a user's arms and chest region according to the principles of isokinetics.

PRIOR ART

Exercise devices and apparatus specifically designed to affect the arms and chest region are common in the exercise and therapy industries. However, most such devices and apparatus utilize a complex system of weights, pulleys, cables and joints, and are, therefore, expensive and complicated to operate. Prior art efforts to simplify such machinery, thus facilitating ease of use while decreasing manufacturing costs, have been largely unsuccessful. The prior art most closely related to the present invention generally comprises a fairly long, straight and relatively stiff steel spring, such as those used to assist in the opening and closing of retractable garage doors, with a handle at each end thereof. To operate, equal and opposite inward forces are exerted at the handles by the user, which cause the spring to bow, or curve. Repeated bowing has been found to substantially accelerate metal fatigue in the spring, which not only undermines the structural integrity of the apparatus, but creates a potential and sometimes an actual safety hazard as well. The spring is susceptible to complete failure while stressed into an arcuate configuration just in front of the user's face and has, in the past, caused serious facial injury.

BRIEF SUMMARY AND OBJECTS OF THE INVENTION

In brief summary, the present invention overcomes or substantially alleviates the prior art fatigue problem briefly mentioned above by providing a novel, simplified, isokinetic exercise apparatus designed to strengthen the muscles of the chest area and arms without risk of serious injury. The present device comprises a relatively short segment of relatively stiff cable which is straight when in an unstressed position and curvilinearly stressed when in use. Two handles are mounted to the cable, one positioned at each end of the cable. The cable is manufactured of such a material and in such a way as to accommodate repeated high flexure stress in one or several directions without fatigue. The length thereof may be any desired distance which accommodates the intended use.

After firmly grasping the handles of the apparatus, the operator exerts equal and opposite inward forces on opposed ends of the cable in a manner whereby the handles at opposite ends are drawn closer together or caused to touch and the cable becomes bowed or curved. Upon reaching a point where the handles meet and/or the operator's ability to exert force is exhausted, manual force on the handles is reduced and the memory of the cable causes the cable to substantially return to the at rest, nearly straight position. This procedure is repeated according to the user's abilities and purposes.

The force required to bow the cable may be altered by varying the length of the flexure device or by varying the diameter and/or number of strands and/or the number of helically coiled cable layers. The handles are preferably very durable, provide good gripping surfaces and are rigidly connected to the ends of the cable. Self adjusting hand straps adjacent the handles, accommodate insertion of the hands of the user without requiring any particular orientation and provides assurance against inadvertent manual release of the exercise device.

With the foregoing in mind, it is a primary object of this invention to provide a novel isokinetic exercise apparatus which builds and strengthens the arms and chest area and which is simple in its construction.

A further principal object is to provide an exercise apparatus that builds and strengthens the arms and chest area, and which comprises a centrally disposed cable which is sharply flexed during use without risk of fatigue failure even when used regularly over an extended period of time.

A further significant object is to provide an isokinetic exercise apparatus that builds and strengthens the arms and chest area, and which possesses one or more of the following features and advantages: safe, efficient, effective, long lasting, easily operated, inexpensive, utilizes few parts, lightweight, easily transportable, not bulky and not complex.

These and other objects and features of the present invention will be apparent from the detailed description taken with reference to the accompanying drawings.

DETAILED DESCRIPTION OF THE ILLUSTRATED EMBODIMENT

Figures 1, 2:
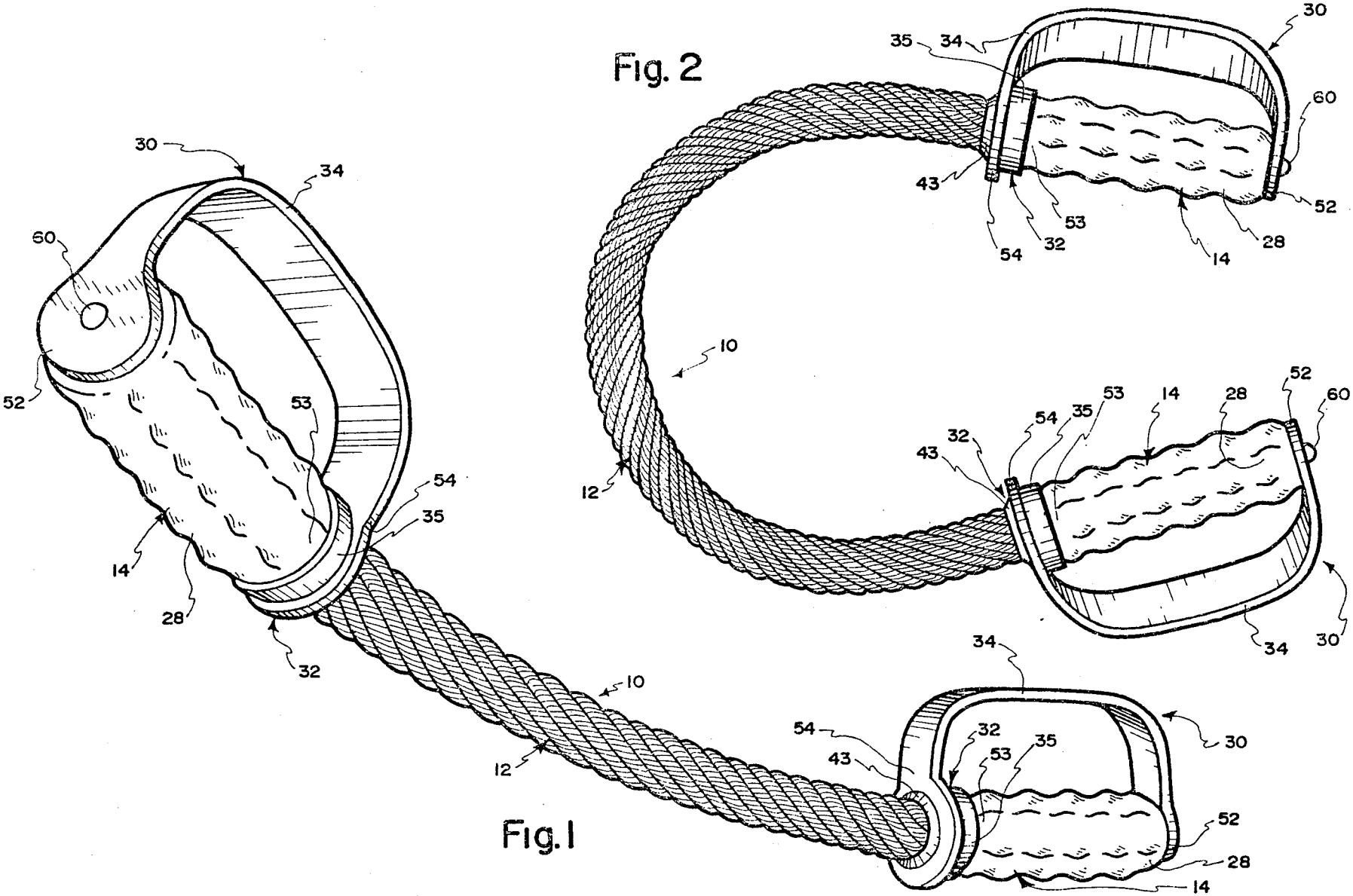
FIG. 1 is a perspective view of a presently preferred isokinetic exercise apparatus, embodying the principles of the present invention, for arms and chest in a substantially linear "at rest" position.
FIG. 2 is an elevation view of the apparatus of FIG. 1 in the "as used" flexed position as seen from the front of FIG. 1.

Reference is now made in detail to the Figures wherein like numerals are used to designate like parts throughout. The Figures illustrate two nearly identical presently preferred isokinetic exercise devices for arms and chest, generally designated 10 and 10', respectively. The device or apparatus 10 comprises a central portion comprising a relatively short length of yieldable, fatigue-resistant commercially available cable or wire rope, generally designated 12, and two identical handles, generally designated 14, one located at each end of the cable 12. See FIGS. 1–3.

The cable 12 comprises a substantially circular cross-section throughout and has a length less than or equal to the maximum span of an average person's arms. The presently preferred length of the cable 12 is marginally longer than the distance between the user's shoulders. In its presently preferred form, the cable 12 is a stiff although manually yieldable standardized commercial steel rope typically used on heavy equipment in the construction industry. Other cable or wire rope configurations can be used which sufficiently resist flexural displacement and which obviates fatigue failure due to repeated flexural stress. The force required to bow the cable 12 from the position of FIG. 1 to that of FIG. 2 may be varied, without departing from the present invention, by varying the length or the diametral size thereof or both. As the length or diametral size is increased or is reduced, the force required to bow or flex the cable 12 is normally increased.

The cable 12 is shown to comprise three layers 16, 18 and 20 of multiple, helically-coiled steel strands 21. See FIG. 6. Each strand 21 in turn conventionally comprises a plurality of helically wound steel wires 22. The layers 16, 18, 20 of strands 21 are conventionally alternately wound in clockwise and counterclockwise directions, and are separated one layer from the next by a thin film of petroleum-based lubricant 24 which allows low friction relative displacement of the layers, strands and wires during flexing by the user. This construction has been found to provide a prolonged usable life of the device 10. In fact, experience to date indicates exercising devices 10 can be manually used indefinitely without structural failure. Although the cable 12 is preferably obtained from a conventional source of construction cable, the exterior of the cable is cleaned to remove a film of lubricant normally coating the strands 21 of the outside layer 20, for cleanliness and safety purposes. Unless costs dictate otherwise, it is preferred that cable 12 be enclosed within a coating of cured suitable synthetic resinous material. Furthermore, commercially available technology can be used to coat the wires, strands and cable itself as the wire rope 12 is being wound whereby the cable and each component thereof becomes encased in a cured coating of suitable plastic. Such coatings must be of a material which yields during bending, where the memory of which causes the coating to return to its unstressed position when the flexure force on the cable is released.

Two substantially similar handles 14 (FIGS. 1–3) and 14' (FIGS. 7 and 8) are illustrated and are presently preferred. Differentiating features are explained hereinafter. Each handle 14 comprises a small section of pipe 26, aluminum or hard plastic, superimposed upon the end of the cable 12. Black pipe may also be used. The length of each pipe section 26 is illustrated as being slightly greater than the width of a human hand. An external plastic or foam rubber hand grip 28 concentrically and contiguously envelops the exterior surface of the pipe 26. The grip 28 is illustrated as comprising solid plastic. The exposed surface of each grip 28 is contoured to improve the manual grasp available to the user. A suitable foam grip may also be used, such as a urethane "GRAB ON" grip from Grab On Products, 100 North Avery, Walla Walla, Wash. 99362. A rotatable loop or strap assembly, generally designated 30, rotatably attaches to the device 10 adjacent both ends of each pipe 26. The user's fingers are inserted through the loop formed by the strap assembly 30 in one direction and the thumb extended in the opposite direction.

Each strap assembly 30 comprises a grooved collar 32, and a flat looped strap 34 of leather, urethane or the like. One end of the strap 34 is rotatably attached at the collar 32.

More specifically, the end 54 of the strap comprises a circular aperture 55 of predetermined diameter. See FIG. 4. The collar 32 comprises a proximal annular wall section 33 comprising an exposed outside surface 35 having a diameter greater than the maximum transverse dimension of the plastic grip 28 and an interior surface 37 the diameter of which is substantially the same as the diameter of the grip 28. Surface 37 is contiguous with the exterior surface of the grip 28. The collar 32 comprises a distal wall 39 integral with the proximal wall 37 at a central reduced diameter portion which forms a groove 41.

The distal wall 39 comprises a tapered exterior surface 43 and an annular interior surface 45. The surface 45 merges with the surface 37 at shoulder 47. The end of the grip 28 abuts the shoulder 47. The yieldability of the strap 34 accommodates force-fitting of the aperture 55 thereof along the surface 43 to the position illustrated in FIG. 4 whereby the strap may be rotated at end 54 in respect to the collar 32.

Also, each section of pipe 26, which has an initial unstressed inside surface 40 (FIG. 3) having a diameter greater than that of the cable 12, is slipped over one end of the cable 12 until the edge 42 of the associated pipe section 26 extends about ¼ to ½ of one inch beyond the end 44 of the cable 12. To assure against slippage, the leading end 48 of each pipe section 26 is uniformly radially crimped upon the cable in a manner whereby the diameter of end 48 is substantially reduced and the two parts are thereby inseparably nonrotatably connected.

While foam handle grips are presently preferred, each pipe section 26 may be dipped into a liquified viscous plastic or synthetic rubber such that the outside surface 50 of each pipe section is completely immersed. The plastic is then allowed to harden and cure into a solid state to comprise hand grip 28. The wall surface 37 of each collar 32 is force-fit over the forward end 53 of the associated grip 28 to hold the collar in its assembled position.

The purpose of the strap 30 is to provide a safety mechanism whereby the cable 12 will not be inadvertently released by the user when in the curved or flexed condition, which would otherwise risk injury to the user. Strap 30 is freely rotatable by the associated grip 28 about the longitudinal axis thereof so that no special orientation is required to achieve a grasp by the user.

Figures 3, 4, 5, 6:
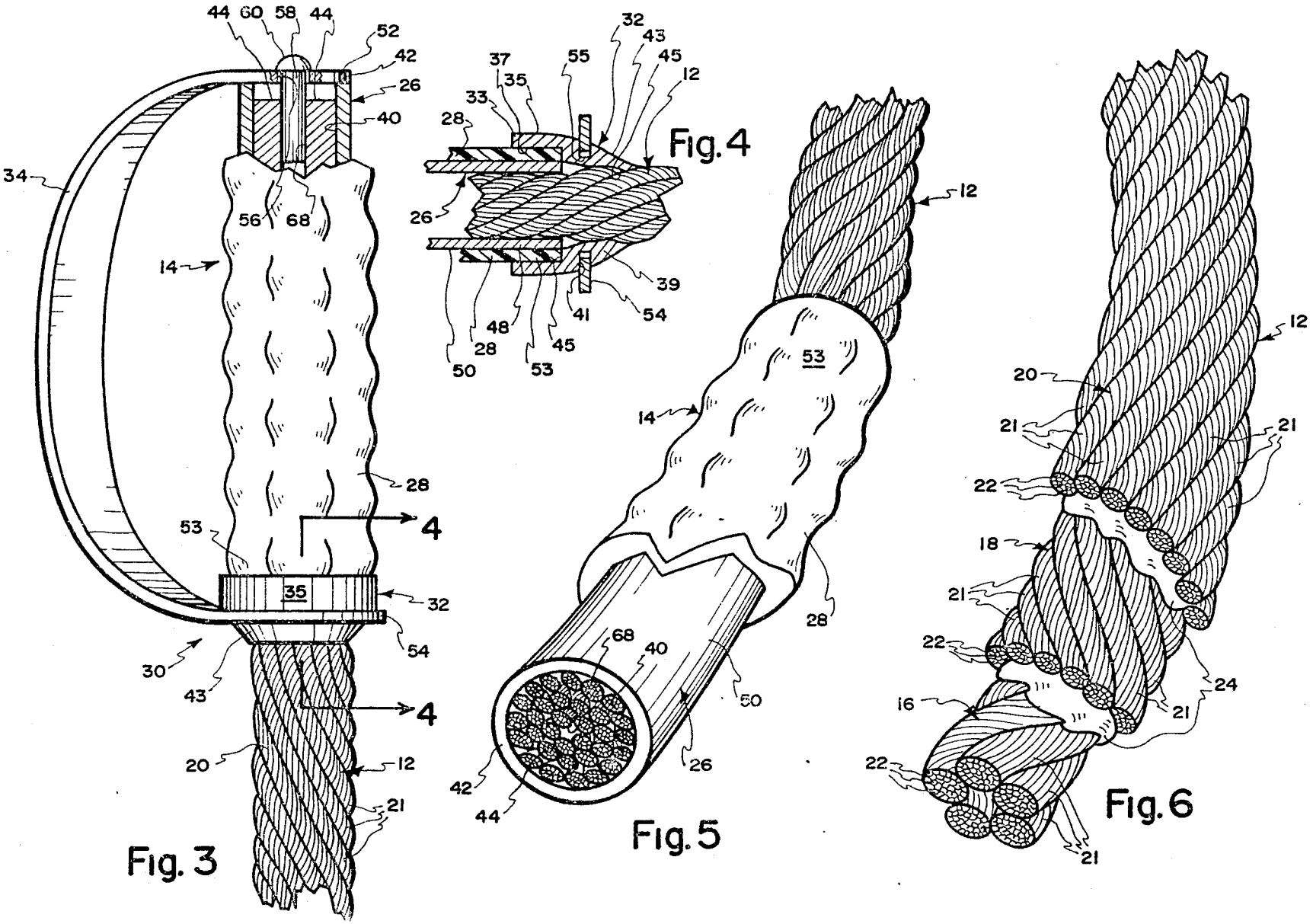
FIG. 3 is an enlarged fragmentary elevation view of one handle of the apparatus in FIG. 1.
FIG. 4 is a fragmentary cross-section taken along lines 4—4 of FIG. 3.
FIG. 5 is an enlarged fragmentary perspective view of one hand region of the apparatus of FIG. 1 with parts broken away and in section for clarity.
FIG. 6 is an enlarged fragmentary perspective view of the central cable region of the apparatus of FIG. 1 with parts broken away and in section for clarity.

A rivet 50, best shown in FIG. 3, rotatably secures the strap end 52 to the end 44 of the cable 12. An aperture 56 extends through the strap 34 at the end 54 thereof, the diameter of which is slightly greater than the assembled diameter of the shaft 58 of the rivet 50. Thus, the aperture 56 is of such a diameter that it slides over the outside surface rivet shaft 58. Accordingly, each strap 30 is able to freely rotate about the rivet shaft 58 with which it is associated.

The head 60 of the rivet 50 has a diameter greater than the diameter of the strap aperture 56 so that the end 52 of the associated strap cannot be axially displaced to any material extent after assembly. The male shaft 58 of the rivet 50 is nonrotatably wedged into a blind bore 68 drilled axially into the end 44 of the cable 12.

The second illustrated handle assembly 30' is very similar to handle embodiment 30. Parts which are identical are labeled with identical numerals in FIGS. 7 and 8 and no future description is made. Thus, only the differences between handle assembly 30' and 30 will be described. Grip 28' differs from grip 28 only in the provision of inwardly directed radial fore and aft flanges 80 and 82. Flange 80 covers the leading edge of the associated pipe edge and is contiguous with the exterior of the cable at aperture 83. Flange 82 covers substantially all of the trailing end of the handle 30' and comprises a relatively small central aperture 84.

The hollow blind bore at the trailing end of the pipe section 26 of the handle assembly 30', between the end of the cable 12 and the flange 82, is filled with a disk of rigid plastic 86 which is adhered to the cable end 44 and has a tapered axially aligned threaded blind bore 88 exposed at the trailing end thereof. The bore 88 is aligned with aperture 84 and with aperture 56 in end 52 of the strap 14'.

Figure 8:
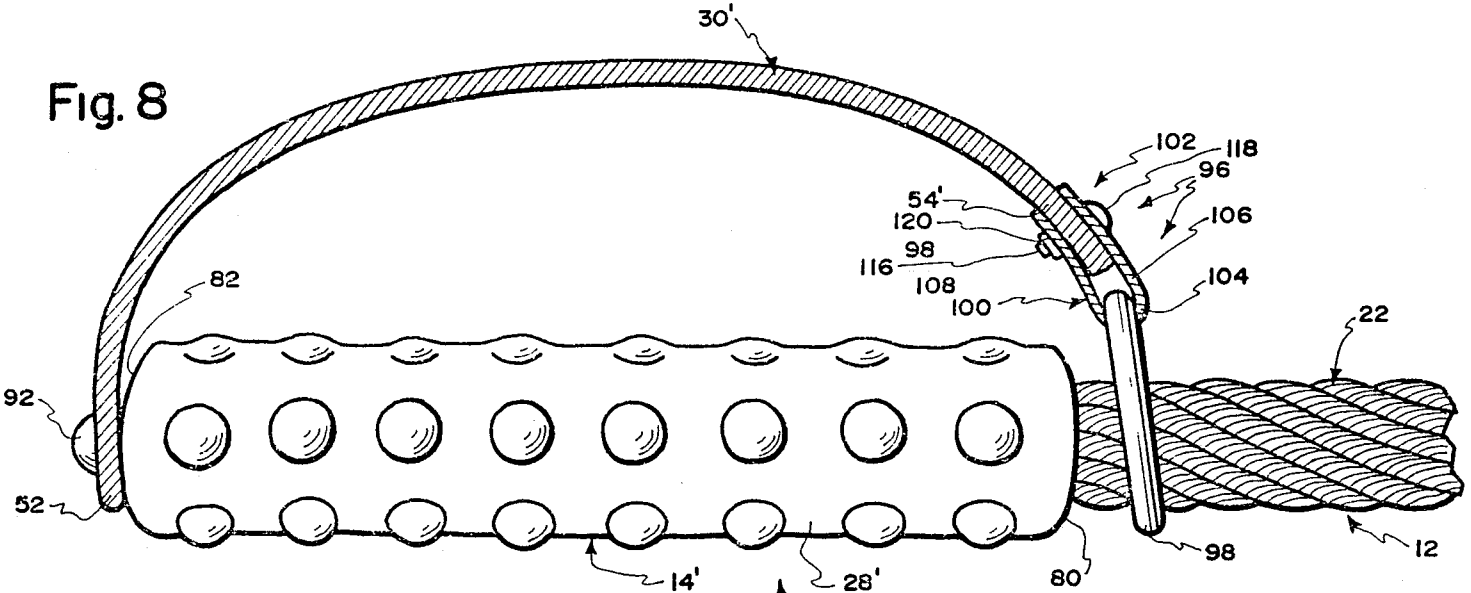
FIG. 8 is an enlarged fragmentary elevational view of the handle of FIG. 7.
Figure 7:
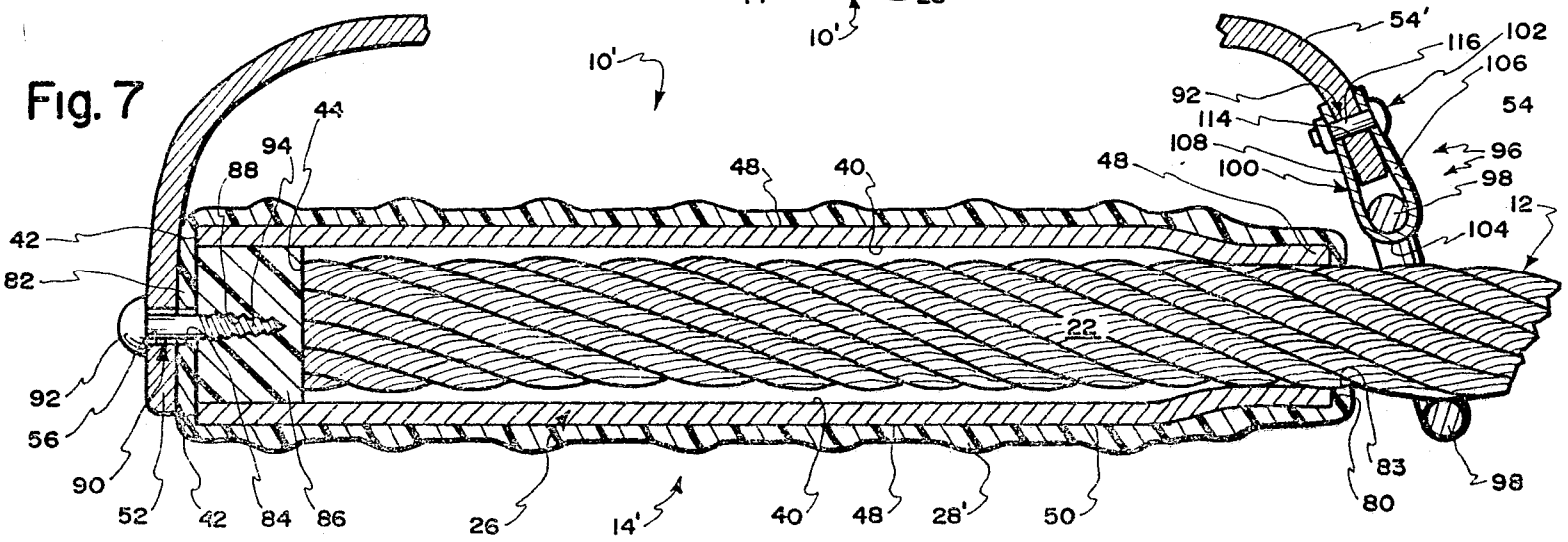
FIG. 7 is an enlarged fragmentary longitudinal cross-sectional elevation view of a second presently preferred handle for use as part of exercising devices according to the present invention.

A screw 90 having an enlarged head 92, the diameter of which is substantially greater than the diameter of apertures 56 and 84, is threadedly engaged at shaft 94 with the threads of blind bore 88 so that the strap end 52 is rotatably secured in the position illustrated in FIGS. 7 and 8.

Collar 32 does not comprise part of handle assembly 30'. Rather, the leading end 54' of the strap is equipped with a ring mechanism, generally designated 96, which rotatably joints the leading end of the strap 30' to the cable 12. The ring mechanism 96 comprises a solid ring 98, made of brass or other suitable material, a flat metal U-shaped clasp 100, which connects the ring 98 to the strap end 54', and a fastener 102 which connects the clasp to the strap end 54'. The ring 98 has an inside diameter substantially larger than that of the cable 12 yet smaller than that of the outside diameter at the grip 28'. The ring 98 is slipped onto the cable 12 prior to placement and attachment of the pipe section 26 to the end of the cable 12.

The U-shaped clasp 100 preferably comprises a flat thin piece of metal, such as steel, and is looped about the ring 38 such that they are interlocked together and the ring 38 is contiguous with the closed end 104 of the clasp 100, as shown in FIG. 8.

The open end 84 of the clasp 100 comprises opposed sides 106 and 108, the sides respectively defining aligned aperture 110, 112. A small aperture 114 is disposed through the strap 30' at the proximal end 54' thereof which is aligned with apertures 110 and 112 and is of sufficient size to accommodate receipt of the fastener 102.

More specifically, the proximal end 54 of the strap 34 is inserted between the prongs 106 and 108 of the clasp 100 so as to linearly align all three apertures 110, 112 and 114. The male threaded shaft 116 of the bolt of the fastener 102 is inserted through the apertures 110, 112 and 114. The fastener 102, so inserted, is secured in place by an enlarged bolt head 118 on one side and a nut 120 threaded on the shaft at the other side. The handle mechanism 30' thus rotates to accommodate receipt of the hand of the user at any location along the 360° exterior of the handle 14' and further functions to prevent inadvertent release of the end of the cable exercise device particularly when highly flexed during use.

The invention may be embodied in other specific forms without departing from the spirit or essential characteristics thereof. The present embodiments, are, therefore, to be considered in all respects as illustrative and not restrictive, the scope of the invention being indicated by the appended claims rather than by the foregoing description, and all changes which come within the meaning and range of equivalence of the claims are therefore to be embraced therein.

What is claimed and desired to be secured by United States Letters Patent is:

1. An elongated flexure exercise device for building and strengthening the arms and chest area of a user comprising:

centrally disposed substantially linear metal cable means having memory and comprising opposed ends spaced one from the other by a distance accommodating simultaneous manual grasping at each end, said cable means further comprising a plurality of wound layers of strands superimposed concentrically upon each other;

handle means carried in exposed relation at each end of the cable means at which a use oppositely grasps the device and oppositely inwardly places the cable means into a bowed configuration under flexure stress counter to the memory of the cable means.

2. An elongated flexure exercise device according to claim 1 wherein the wound layers of strands are oppositely wound and are coated with flexible covering means.

3. An elongated flexure exercise device according to claim 1 wherein the handle means are nonrotatably anchored at each end of the cable means.

4. An elongated flexure exercise device according to claim 1 further comprising strap means attached at each end of the cable means in loop relation to the associated handle means through which the user places one hand whereby loss of the user's grasp upon either handle means during use will not result of loss of control of the device or injury to the user.

5. An elongated flexure exercise device according to claim 4 wherein the strap means are each rotatably secured to one end of the cable means in said looped relation.

6. An elongated flexure exercise device according to claim 1 wherein each handle means comprises a length of pipe superimposed over one end of the cable means and nonrotatably connected thereto.

7. An elongated flexure exercise device according to claim 6 wherein elastomeric material covers each pipe section and is exposed for grasping by the user.

8. An elongated flexure exercise device according to claim 1 wherein the cable means comprise a multilayer, multistrand, multiwire rope.

* * * * *